United States Patent [19]

Inagaki

[11] Patent Number: 4,736,698

[45] Date of Patent: Apr. 12, 1988

[54] THREAD TAKE-UP DEVICE FOR A SEWING MACHINE

[75] Inventor: Hidetaka Inagaki, Nagoya, Japan

[73] Assignee: Brother Kogyo Kabushiki Kaisha, Nagoya, Japan

[21] Appl. No.: 948,172

[22] Filed: Dec. 31, 1986

[30] Foreign Application Priority Data

Jan. 21, 1986 [JP] Japan ..... 61-10843

[51] Int. Cl.[4] ..... D05B 49/00

[52] U.S. Cl. ..... 112/247

[58] Field of Search ..... 112/181, 57, 242, 244, 112/245, 247

[56] References Cited

U.S. PATENT DOCUMENTS

| | | | |
|---|---|---|---|
| 197,107 | 11/1877 | Cushman | 112/247 |
| 1,108,348 | 8/1914 | Druckerman | 112/247 X |
| 1,245,338 | 6/1917 | Hayes | 112/247 |

FOREIGN PATENT DOCUMENTS

| | | | |
|---|---|---|---|
| 1928811 | 12/1970 | Fed. Rep. of Germany | 112/247 |

*Primary Examiner*—Wm. Carter Reynolds

*Attorney, Agent, or Firm*—Schwartz & Weinrieb

[57] ABSTRACT

A thread take-up device comprising a loop tightening member adapted to reciprocate within a predetermined range limited by a thread slackening limit position where the loop tightening member is located when a thread loop is expanded to its maximum extent by a loop-seizing member, and a loop tightening limit position for tightening the thread loop; and a movable member adapted to reciprocate within a predetermined range limited by a stopping position defined within the range of reciprocation of the loop tightening member above the loop tightening limit position, and a position corresponding to the thread slackening limit position of the loop tightening member. The respective loci of the recess for engaging the needle thread of the loop tightening member, and the thread catch of the movable member overlap each other. The movable member is normally resiliently biased toward the stopping position by the substantially constant resilience of a resilient part thereof or by means of a separate resilient member, so that a predetermined length of the needle thread is secured during the threading operation irrespective of the stopping position of the loop tightening member, and the thread loop can be smoothly released from the loop-seizing member.

17 Claims, 14 Drawing Sheets

THREAD TAKE-UP DEVICE FOR A SEWING MACHINE

FIELD OF THE INVENTION

The present invention relates to a thread take-up device for a sewing machine which is capable of smoothly removing the needle thread from the shuttle by pulling the needle thread upwardly through the eye of the needle, and of facilitating the threading operation so as to prepare the sewing machine for a sewing operation.

BACKGROUND OF THE INVENTION

In preparing a sewing machine for stitching material, it is necessary to carry out a series of threading procedures including threading a needle thread withdrawn from a spool along a predetermined threadline in a predetermined sequence via threading members including tension disks, a thread take-up spring and a thread take-up lever, and threading the needle thread through the eye of the needle.

In a conventional sewing machine, the needle thread released from the loop seizing beak of the shuttle is sometimes caught by a part of the shuttle when the needle thread is suddenly pulled upwardly by the take-up lever in order to tighten the needle thread, and therefore, in some cases, an excessive length of the needle thread is withdrawn from the spool. In such a case, the stitch is not tightened sufficiently, and hence proper stitches are not formed.

Generally, unskilled operators are liable to achieve improper or correct threading results, and the threading operation is one of the most troublesome tasks even to skilled operators. It is of course essential to carry out the threading operation correctly, because a proper sewing operation is impossible to achieve when the threading operation is defective.

When threading the take-up lever, for example, the take-up lever must be disposed at its uppermost position. If the take-up lever is threaded when disposed at a position other than its uppermost position, the take-up lever moves upwardly toward the uppermost position at the start of the sewing operation thereby tending to withdraw the thread from the eye of the needle. Accordingly, an ordinary sewing machine has a mechanism which is specifically designed to bring the take-up lever to its uppermost position when the sewing machine is stopped.

However, since it is difficult to incorporate such a mechanism into a relatively expensive sewing machine, the operator is required to perform such a troublesome operation every time a threading operation is necessary. In particular, the operator has to manually rotate the hand pulley so as to bring the take-up lever to its uppermost position. Even with a sewing machine having a mechanism to bring the take-up lever to automatically the uppermost position when the sewing machine is stopped, the same manual operation is necessary to rotate the hand pulley, if prior to threading, the hand pulley is accidentally turned, thereby moving the take-up lever downwardly from the uppermost position.

OBJECTS OF THE INVENTION

It is the primary object of the present invention to provide a thread take-up device for a sewing machine which is capable of facilitating the threading operation irrespective of the stopping position of the take-up lever and without requiring the take-up lever to be stopped at the uppermost position.

It is another object of the present invention to provide a thread take-up device for a sewing machine which is capable of smoothly releasing the thread from a loop seizing member.

SUMMARY OF THE INVENTION

In order to solve the foregoing problems of the noted conventional sewing machines, the present invention provides a thread take-up device for a sewing machine having an endwise reciprocating needle with an eye, a loop seizing member operable in timed relation respect to the reciprocation of the needle for seizing a thread loop formed at the eye of the needle and for subsequently expanding the thread loop to its maximum extent, and a thread passage extending from the thread supply spool to the eye of the needle. The thread take-up device comprises a loop tightening member operable to tighten the thread loop in timed relation respect to the reciprocation of the needle and adapted to reciprocate within a predetermined range between a thread slackening limit position where the loop tightening member is disposed when the loop is expanded to its maximum extent by the loop seizing member, and a loop tightening limit position where the loop tightening member is disposed so as to tighten the loop; a movable member disposed adjacent the loop tightening member so as to move along a path coincident with the locus of the reciprocation of the loop tightening member for tightening the loop and capable of moving from a predetermined stopping position located adjacent the loop tightening limit position toward the thread slackening limit position; and an elastic member for urging the movable member toward the predetermined stopping position. With this arrangement, the movable member may take up the thread from the eye of the needle by means of the elastic force of the elastic member when the loop tightening member is located between the predetermined stopping position and the thread slackening limit position.

With the thread take-up device thus constructed in accordance with the present invention, the movable member engages the needle thread and urges the needle thread under the influence of the elastic member, in such a direction as to take-up the needle thread from the eye of the needle when the loop tightening member is located at a position between the predetermined stopping position of the movable member and the thread slackening limit position. Accordingly, when located at the predetermined stopping position, the movable member is able to secure a sufficient length of the needle thread irrespective of the position of the loop tightening member.

Thus, the thread take-up device according to the present invention always urges the needle thread in such a direction as to cause take-up of the needle thread from the eye of the needle by means of the movable member when the loop tightening member is located at a position between the predetermined stopping position of the movable member and the thread slackening limit position. Therefore, a pulling force is immediately exerted upon the needle thread after the loop has been released from the loop seizing member so that the needle thread can be reliably separated from the loop seizing member.

Furthermore, the thread take-up device facilitates threading the needle thread withdrawn from the thread supply spool prior to commencement of the sewing operation and securing a sufficient length of the needle thread irrespective of the stopping position of the loop tightening member.

Still further, since the conventional sewing machines employ a thread take-up spring, an excessive length of needle thread is withdrawn by the thread take-up spring when the thread tension is decreased by loosening the tension disks for performing a sewing operation upon a thin piece of work, thereby causing insufficient tightening of the thread. In contrast, since the sewing machine incorporating the present invention does not employ a thread take-up spring, an excessive amount of needle thread is not withdrawn even if the thread tension is decreased, and therefore the needle thread is properly tightened irrespective of the thickness of the work fabric.

DESCRIPTION OF THE DRAWINGS

Various other objects, features, and attendant advantages of the present invention will become more apparent as the same becomes better understood from the following detailed description when considered in connection with the accompanying drawings, in which like reference characters designate like or corresponding parts throughout the different views, and wherein.

DESCRIPTION OF THE PREFERRED EMBODIMENT

A thread take-up device for a sewing machine according to a preferred embodiment of the present invention will be described hereinafter with reference to the accompanying drawings.

Figure 6:
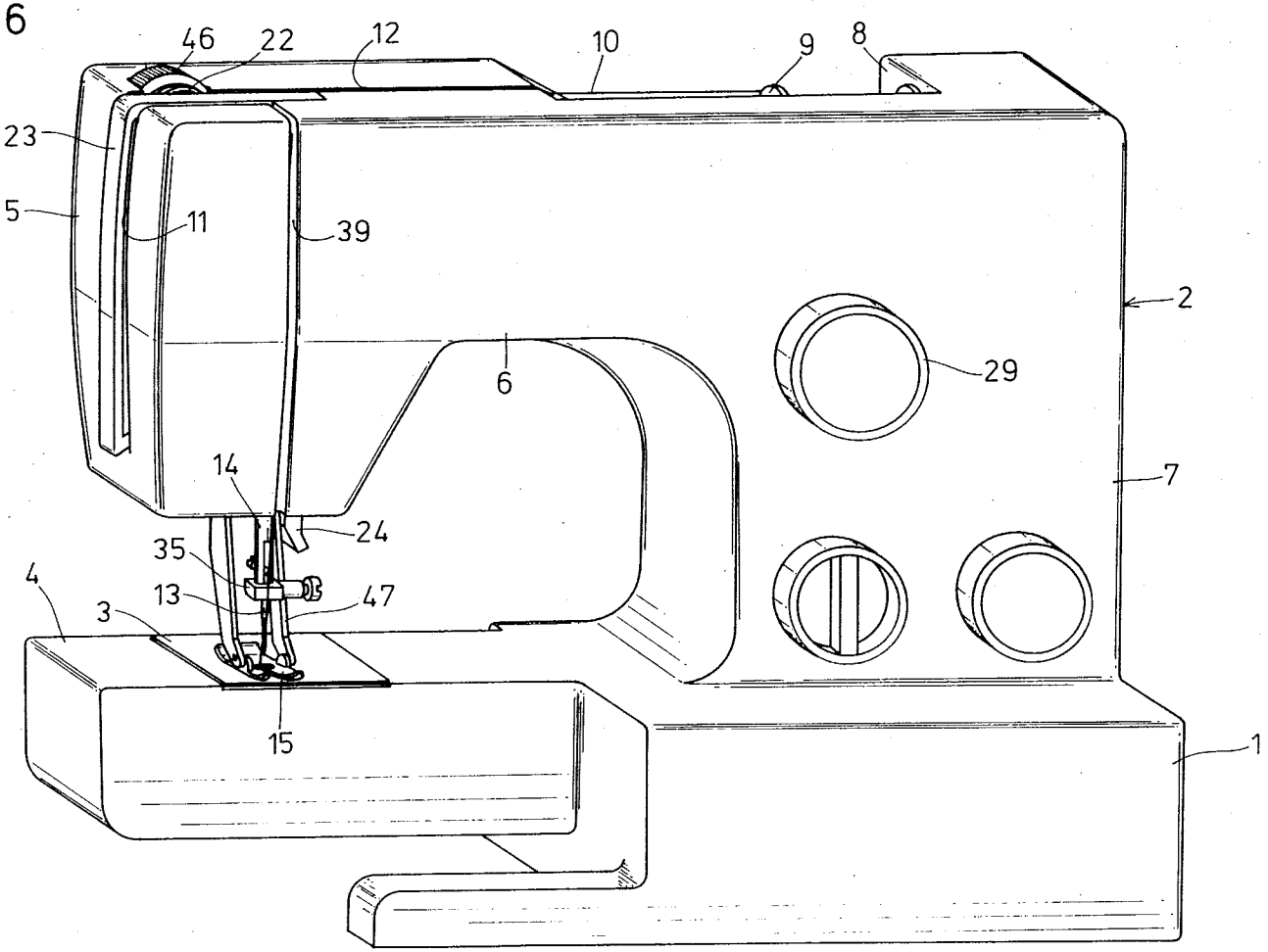
FIG. 6 is a perspective view showing the general appearance of a sewing machine equipped with the thread-take-up device according to the present invention.

Basic Construction of the Sewing Machine:

Referring particularly to FIG. 6, basically, a machine frame 2 comprises a base 1, a lower arm 4 extending horizontally from the base 1 and having a throat plate 3 in the upper surface thereof, an upper arm 6 extending over and parallel to the lower arm 4 and having a sewing head 5 at the free end thereof, and a standard 7 connecting the lower arm 4 and the upper arm 6. The machine frame 2 is fabricated from a tough molded plastic material so as to render the same lightweight in construction. A spool 9, namely, a thread supply, is supported on a horizontal spool pin, not shown, mounted within a recess 8 formed in the upper wall of the upper arm 6. A needle thread 10 withdrawn from the spool 9 is inserted into a linear guide groove 12 extending between the recess 8 and an opening 11 formed in the sewing head 5.

A needle bar 14 having a needle 13 disposed therein extends downwardly from the sewing head 5 and a presser foot 15 is supported from the lower end of the sewing head 5 so as to be disposed beneath the needle bar 14. A needle bar reciprocating mechanism for vertically reciprocating the needle bar 14, and a presser foot lifting mechanism will be described later. As illustrated in FIGS. 7A to 7H, a vertically disposed shuttle 16 is provided in the lower arm 4 below the throat plate 3 for rotational reciprocation within a range corresponding to one half of one revolution. During the sewing operation, the loop seizing member (loop-seizing beak) 16*a* of the shuttle 16 arrests a loop 10*a* formed in the needle thread 10 as the needle 13 moves upwardly from below the throat plate 3.

Figure 1:
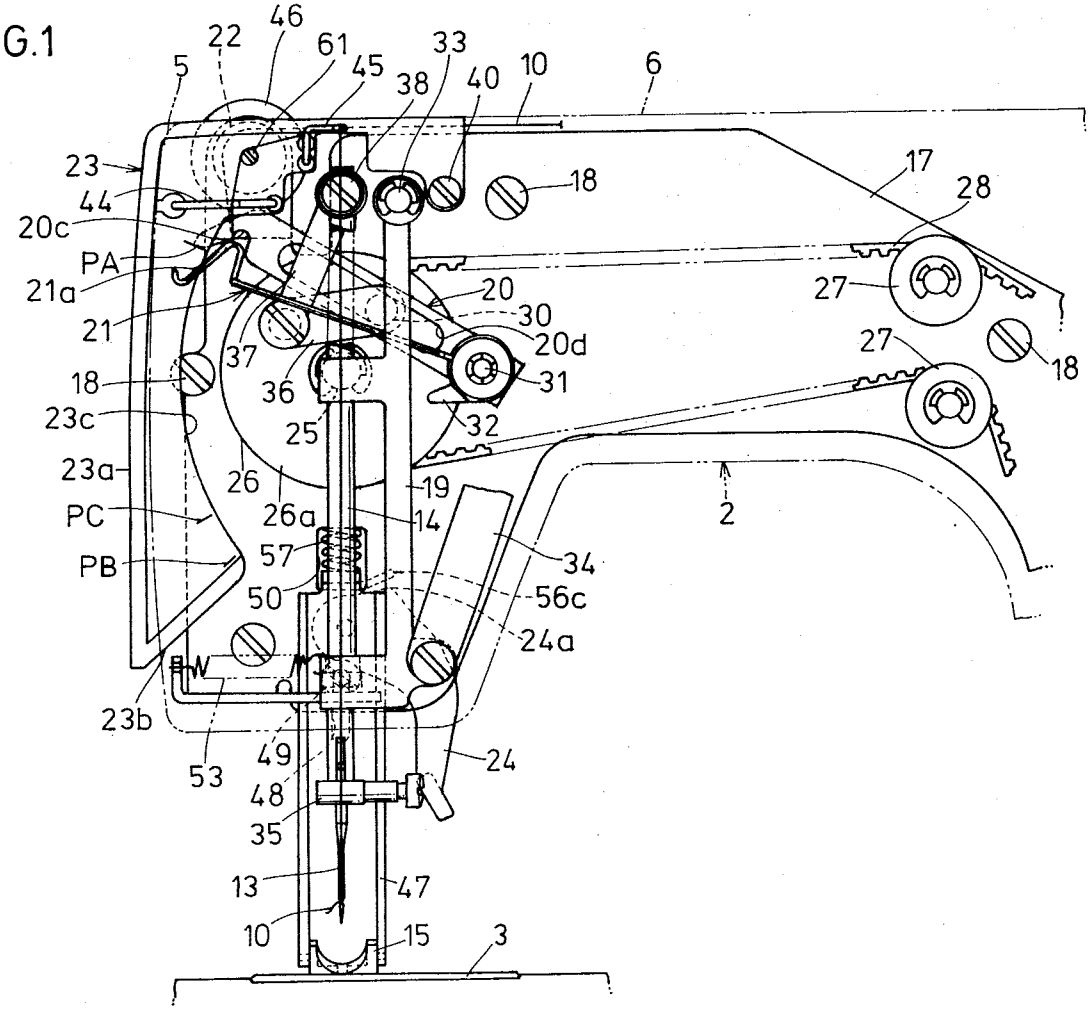
FIG. 1 is a longitudinal sectional view showing the interior of the sewing head of a sewing machine incorporating a thread take-up device according to a preferred embodiment of the present invention, in which a loop tightening member is located at a thread slackening limit position.
Figure 2:
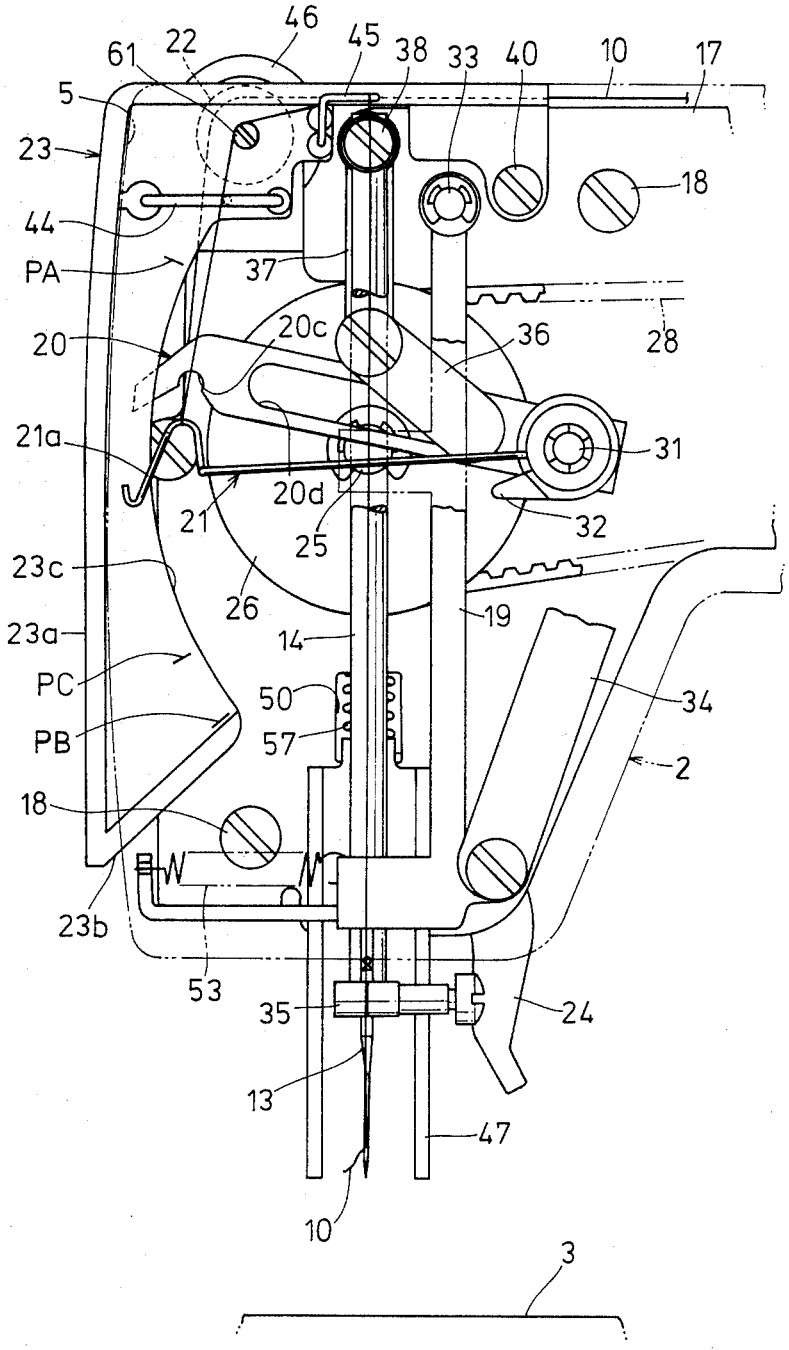
FIG. 2 is a longitudinal sectional view showing the interior of the sewing head of FIG. 1, in which the loop tightening member is located at a position between the thread slackening limit position and a loop tightening limit position.
Figure 3:
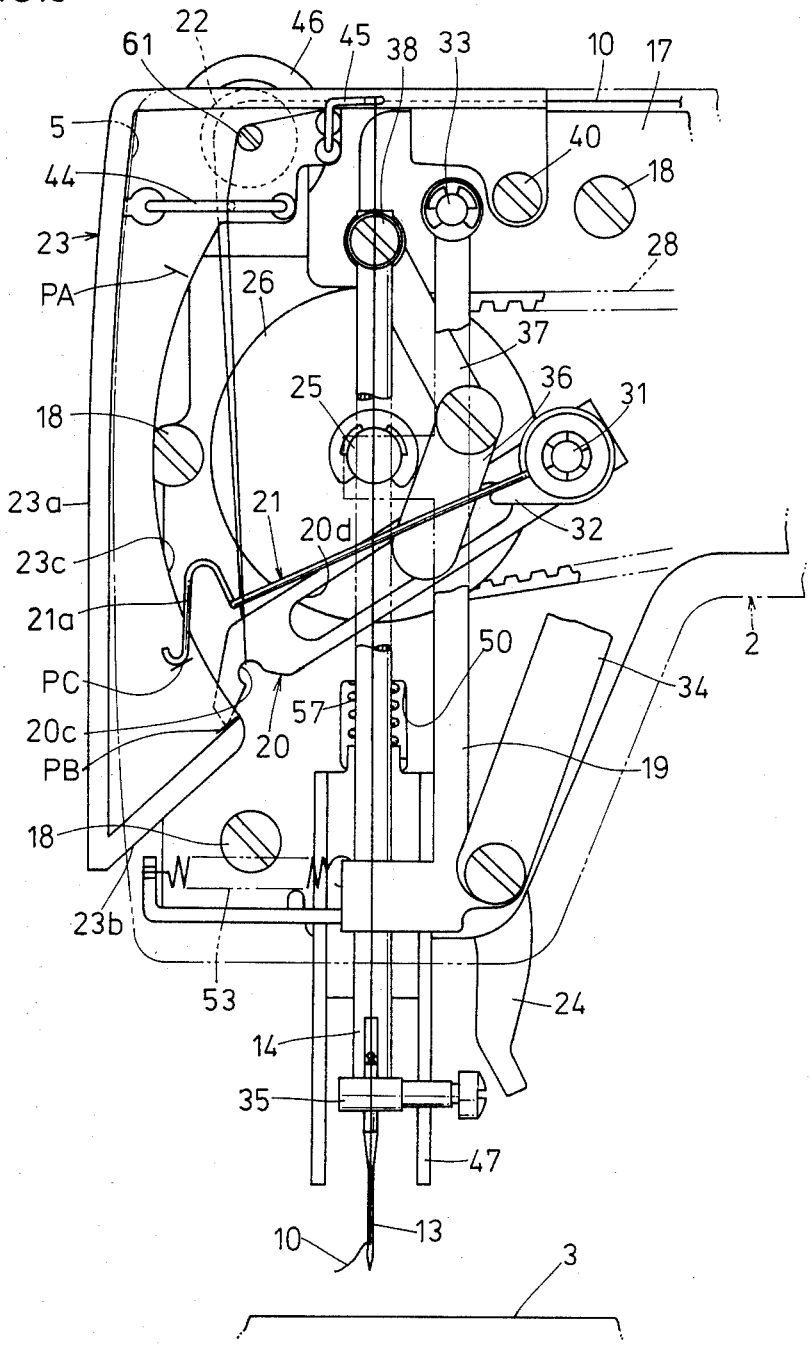
FIG. 3 is a longitudinal sectional view showing the interior of the sewing head of FIG. 1, in which the loop tightening member is located at the loop tightening limit position.

As illustrated in FIGS. 1 to 3, a supporting plate 17 made from a steel plate of a required shape is secured to the machine frame 2 with a suitable number of bolts 18. A needle bar swinging frame 19, a loop tightening member 20, a movable member 21 a belt-type power transmitting means for driving these components are supported on the front side, namely, the side facing the operator, of the supporting plate 17. Tension disks 22 and a cover 23 are attached to the upper portion of the supporting plate 17. A presser foot lifting lever 24 and other components of the machine are appropriately attached at predetermined positions on the backside of the supporting plate 17.

Figure 4:
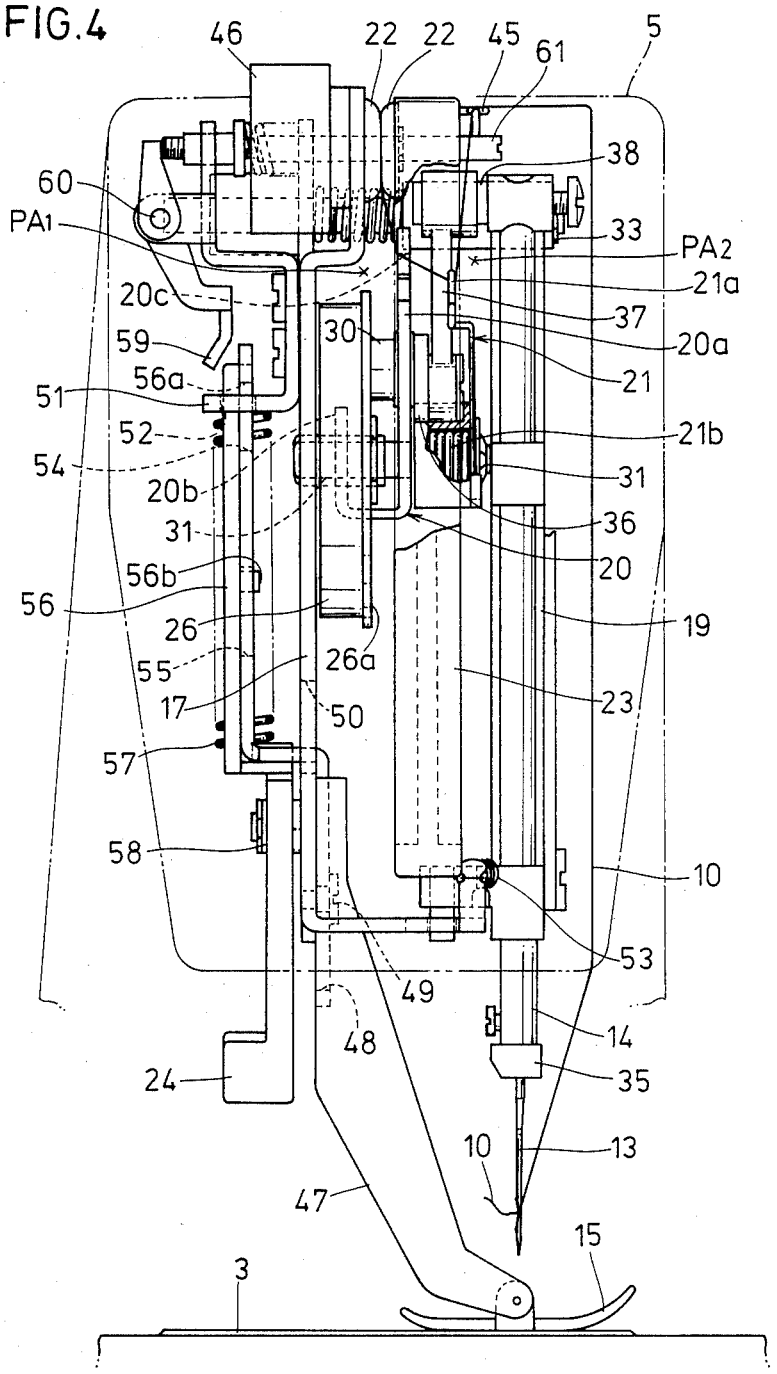
FIG. 4 is a left-hand side elevation of the sewing head of FIG. 1.

As illustrated in FIGS. 1 and 4, a large-diameter timing pulley 26 is rotatably supported on a rotary shaft 25 disposed on the supporting plate 17. The timing pulley 26 is driven in the clockwise direction by means of a timing belt 28 trained around the timing pulley 26, guide pulleys 27 and a driving pulley, not shown. The timing belt 28 can also be driven by manually operating a hand pulley 29 shown in FIG. 6.

A fixed shaft 30 is attached to a disk 26*a* of the timing pulley 26 so as to project radially therefrom at a position radially removed from the center of rotation of the timing pulley 26 by a predetermined distance. The fixed shaft 30 engages a slot 20*d* formed in the loop tightening member 20 so as to reciprocate the loop tightening member 20 within a predetermined angular range. The fixed shaft 30 also drives the needle bar 14 which is provided on the needle bar swinging frame 19 for vertical reciprocation. A fixed shaft 31 is provided on the supporting plate 17 adjacent the timing pulley 26. The fixed shaft 31 supports the loop tightening member 20 and the movable member 21 so that the loop tightening member 20 and the movable member 21 are pivotable within predetermined angular ranges, respectively.

Loop Tightening Member:

The loop tightening member 20 serves to tension the needle thread 10 at a predetermined timing time so as to tighten the loop 10*a* released from the loop-seizing beak 16*a* of the shuttle 16. As illustrated in FIG. 4, the substantially U-shaped loop tightening member 20 has a long arm 20*a* and a short arm 20*b* extending parallel to the long arm 20*a*. The short arm 20*b* of the loop tightening member 20 is mounted on the fixed shaft 31 for pivotal movement within a predetermined angular range.

The loop tightening member 20 is pivotally mounted on the fixed shaft 31 such that the long arm 20*a* is movable in front of the disk 26*a* of the timing pulley 26. A recess 20*c*, as best seen in FIG. 1, for catching the needle thread 10 is formed in the lower surface of the free end of the long arm 20*a*. A slot 20*d* having a predetermined length is formed longitudinally in the long arm 20*a*. The fixed shaft 30 projecting from the timing pulley 26 is received in the slot 20*d* of the long arm 20*a*. Accordingly, as the timing pulley 26 is rotated in a predetermined direction, the loop tightening member 20 is reciprocated by means of the fixed shaft 30 within the predetermined angular range about the fixed shaft 31, as seen from FIGS. 1 to 3. The angular range of reciprocation of the loop tightening member 20 is defined by a thread slackening limit position PA (hereinafter referred to as "the uppermost position PA") at which the loop tightening member 20 is located when the loop 10*a* of the thread 10 formed near the eye of the needle 13 is expanded to the maximum extent by the loop arresting member 16*a* (FIG. 7E), and a loop tightening limit position PB (hereinafter referred to as "the lowermost position PB") at which the loop tightening member 20 is located in order to tighten the loop 10*a* (FIGS. 3 and 7H). The loop tightening member 20 is reciprocated within this angular range in timed relation respect to the vertical reciprocation of the needle 13.

Movable Member:

The fixed shaft 31 pivotally supporting the loop tightening member 20 also pivotally supports the movable member 21 which normally biases or tensions the threaded needle thread 10 in a direction away from the eye of the needle 13 except when the needle thread 10 is tensioned or tightened by the loop tightening member 20. The movable member 21 is formed of an elastic metallic wire. The free end of the movable member 21 is bent into a substantially S shape as shown in the drawings so as to form a thread catch 21*a*, while the other end of the same is coiled so as to form a resilient part 21*b* in the form of a torsion coil spring. As illustrated in FIG. 4, the resilient part 21*b* is mounted on the fixed shaft 31 extending perpendicular to a plane in which the movable member 21 moves so as to bias the movable member 21 with a substantially constant force toward a predetermined stopping position PC as shown in FIG. 3. The movable member 21 may be biased toward the stopping position PC by means of a separate resilient member instead of biasing the movable member 21 in the same direction by the resilient part 21*b*, which is an integral part of the movable member 21. However, since a substantially constant resilient force must be applied to the movable member 21 over the entire pivotal movement thereof, it is most preferable to employ a torsion coil spring for the resilient part 21*b*.

The stopping position PC of the movable member 21 is set to be within the range of motion of the loop tightening member 20 above the lowermost position PB. A stopper 32 is provided on the fixed shaft 31 so as to hold the movable member 21 at the stopping position PC. Accordingly, the movable member 21 pivots upon the fixed shaft 31 along an axial locus at least coincident with the axial locus about which the loop tightening member 20 moves for tightening the loop. However, the range of pivotal movement of the movable member 21 extends from the stopping position PC above the lowermost position PB of the loop tightening member 20 in a direction in which the tightening member 20 is moved for slackening the needle thread 10 toward the vicinity of the uppermost position PA.

Needle Bar Swinging Frame:

Referring to FIGS. 1 and 4, the needle bar swinging frame indicated at 19 is suspended from a fixed shaft 33 which is inserted through the upper part of the supporting plate 17, and a link 34 is connected to the needle bar swinging frame 19 so as to swing the needle bar swinging frame 19 about the axis of the fixed shaft 33 within a predetermined angular range. The needle 13 is secured upon the lower end of the needle bar 14 by means of a needle clamp body 35. The needle bar 14 is supported for vertical reciprocation on the needle bar swinging frame 19. The needle bar 14 is interlocked at the upper end thereof with the timing pulley 26 so that the timing pulley 26 is able to impart vertical oscillation to the needle bar 14.

As illustrated in FIG. 1, a first crank rod 36 is fixed at one end thereof to the fixed shaft 30 provided on the timing pulley 26, and is pivotally connected at the other end thereof to a second crank rod 37. The free end of the second crank rod 37 is pivotally connected to the top of the needle bar 14 by means of a pin 38. Accordingly, as the timing pulley 26 is rotated in the clockwise direction, the needle bar 14 is vertically reciprocated by means of the crank motion of the first crank rod 36 and the second crank rod 37, and the loop tightening member 20 is also vertically reciprocated in timed relation with respect to the reciprocation of the needle bar 14. An extension spring 53 is positioned between the needle bar swinging frame 19 and the supporting plate 17 so as to normally bias the needle bar swinging frame 19 leftward as viewed in FIG. 1.

Thread Guiding Means:

The sewing machine incorporating the present invention is provided with a thread guiding means for guiding the needle thread 10 from the spool 9 to the eye of the needle 13, comprising the guide groove 12 formed in the upper wall of the upper arm 6, and a guide groove 39 formed in the front surface of the machine frame, as illustrated in FIG. 6, and extending adjacent and parallel to the needle bar 14. As illustrated in FIG. 4 and comparing such figure to FIGS. 1 to 3, the thread guiding means guides the needle thread 10 along the guide groove 12 to a first upper position PA1 adjacent the uppermost position PA of the loop tightening member 20, then from the first upper position PA1 toward the loop tightening member 20 located near the lowermost position PB or toward the movable member 21 located at the stopping position PC, and from the loop tightening member 20 or from the movable member 21 via a second upper position PA2 near the uppermost position PA to the eye of the needle 13.

Figure 5:
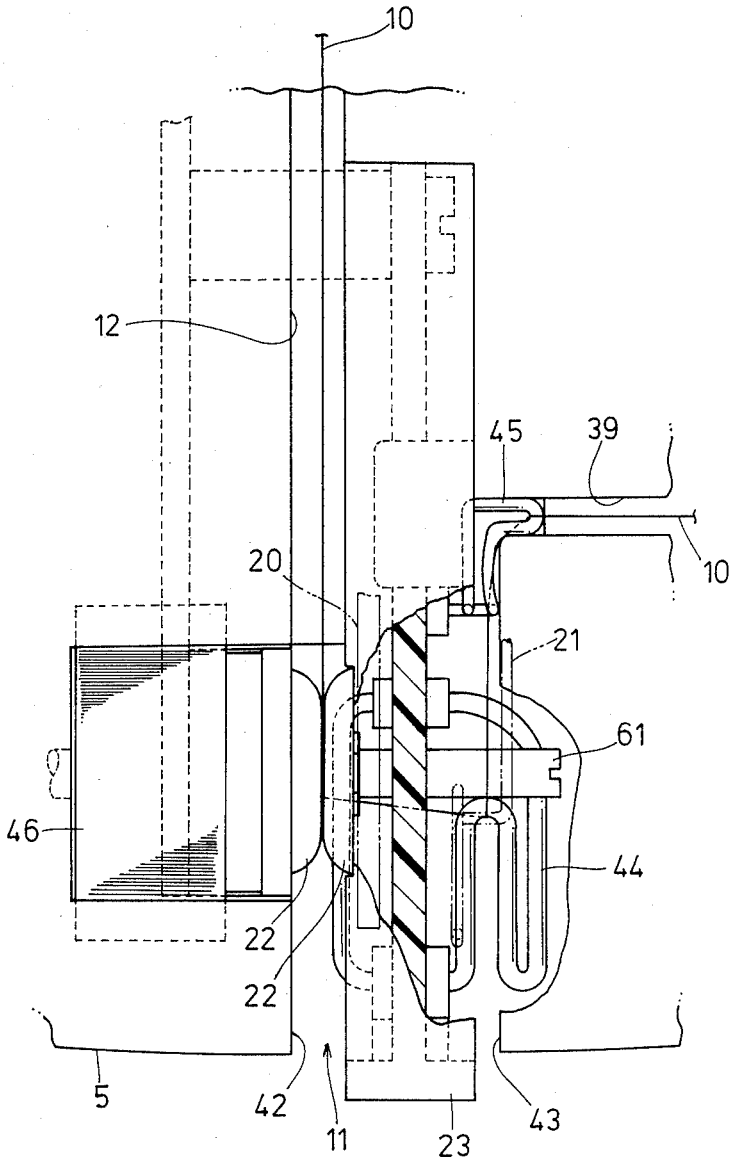
FIG. 5 is an enlarged fragmentry plan view of the sewing head of FIG. 1.

The thread guiding means includes a cover 23 covering the respective entire ranges of motion of the loop tightening member 20 and the movable member 21. As illustrated in FIGS. 5 and 6, a vertically elongate opening 11 having a predetermined width is formed in the left-hand surface of the sewing head 5 at the free end of the upper arm 6 so as to communicate with the linear guide groove 12 at the top of the upper arm 6. The cover 23 is fabricated from a synthetic resin and is formed into a shape as best shown in FIG. 1. The cover 23 is inserted in the opening 11 and is pivotally supported on a pin 40, as best seen in FIGS. 1–3, so as to be capabile of being raised upwardly.

As best shown in FIG. 1, the cover 23 has an arcuate front surface 23*a* which is slightly curved convexly outwardly. The arcuate surface 23*a* projects outward from the left-hand surface of the sewing head 5. An inclined surface 23*b* inclining upwardly toward the interior of the sewing head 5 is formed at the lower end of the cover 23. A concave arcuate surface 23*c*, having a large curvature radius, is formed upon the inner portion of the cover 23 opposite to the arcuate surface 23*a*. The arcuate surface 23*a* and the inclined surface 23*b* guide the needle thread transversely across the plane of the range of motion of the loop tightening member 20 to the needle 13 after the needle thread 10 has passed through the tension disks 22.

As is apparent from FIG. 5, when the cover 23 is positioned in place within the opening 11, a left guide groove 42 and a right guide groove 43 are formed between the side edges of the cover 23 and the opposite sides of the opening 11. As may be seen in FIG. 4, the loop tightening member 20 moves through a space on the left side of the cover 23 without touching the cover 23, while the movable member 21 moves through a space on the right side of the cover 23 without touching the cover 23. The arcuate surface 23*c* of cover 23 is sized so as to be positioned inside the respective circular loci of the free end of the loop tightening member 20 and the free end of the movable member 21.

Referring to FIGS. 2 and 5, a first thread guide 44 formed by bending a wire into a U-shape is disposed on the right side of the upper part of the cover 23. A second thread guide 45, also formed by bending a wire so as to have a substantially L-shaped configuration in cross-section, is disposed at an inner position in the upper part of the cover 23 so as to change the feeding direction of the needle thread 10 through a right angle toward the guide groove 39 formed in the front surface of the sewing head 5. The two tension disks 22 are disposed on the left side, as viewed in FIG. 5, of the opening 11. The pressure of the tension disks 22 to be applied to the needle thread 10 is adjustable by means of a tension knob 46.

Presser Foot and the Associated Mechanism:

The presser foot 15 and an interlocking mechanism for opening the tension disks 22 in association with the movement of the presser foot 15 now be described briefly. As illustrated in FIGS. 1 and 4, a bifurcated presser foot holder 47 having the presser foot 15 mounted on the lower end thereof is supported for vertical movement relative to the supporting plate 17 by inserting a hinge screw 49 through a vertical slot 48 formed in the presser foot holder 47 and fixedly screwing the hinge screw 49 into the supporting plate 17. The upper portion of the presser foot holder 47 is bent so as to have an L-shaped d-configuration. The horizontal section of the L-shaped bent portion extends through a vertical slot 50 formed in the supporting plate 17 and projects outwardly from the backside of the supporting plate 17, while the vertical section of the L-shaped bent portion extends vertically upwardly and parallel to the backside of the supporting plate 17. The upper end of the vertical section is vertically inserted through rectangular hole 52 formed in a bracket 51 attached to the backside of the supporting plate 17.

As illustrated in FIG. 4, an upper slot 54 and a lower slot 55 are formed in the vertical section of the L-shaped bent portion of the presser foot holder 47. An intermediate member 56 is disposed along the vertical section of the L-shaped bent portion of the presser foot holder 47. A bent upper end portion 56*a* of the intermediate member 56 and a pin 56*B* attached to the intermediate member 56 are received in the upper slot 54 and the lower slot 55, respectively. Thus, the presser foot holder 47 and the intermediate member 56 are vertically movable relative to each other.

A compression spring 57 is resiliently interposed between the horizontal section of the L-shaped bent portion of the presser foot holder 47 and a horizontally extending portion of the bracket 51 so as to normally urge the intermediate member 56 and the presser foot holder 47 and hence the presser foot 15 toward the throat plate 3. A presser foot lifting lever 24 is pivotally supported on a fixed shaft 58 fixed to the lower part of the backside of the supporting plate 17. A cam surface 24*a* of the presser foot lifting lever 24, as best seen in FIG. 1, engages a lug 56*c* of the intermediate member 56 in order to elevate the intermediate member 56 together with the presser foot holder 47 against the resilient bias of the compression spring 57.

As illustrated in FIG. 4, when the intermediate member 56 is pushed upwardly, the upper end of the intermediate member 56 is brought into abutment with a lever 59 so as to pivot the lever 59 about a pin 60, whereby a tension rod 61 extending through one of the tension disks 22 and connected to the other tension disk 22 (the right-hand tension disk in FIG. 4) is moved rightward so as to separate the tension disks 22 from each other. Since the presser foot holder 47 and the intermediate member 56, which are pressed downwardly by means of the compression spring 57, are movable relative to each other, only the presser foot holder 47 is raised relative to the intermediate member 56 when many pieces of cloth are to be pressed by the presser foot 15 against the throat plate 3 so that the tension disks 22 are not separated from each other.

Operation of the Thread take-up Device:

The operation of the thread take-up device embodying the present invention now be described hereinafter. First, the procedure for threading the needle thread 10 to be accomplished prior to starting a sewing operation will be explained. As illustrated in FIG. 6, the needle thread 10 withdrawn from the spool 9 is inserted in the guide groove 12 formed in the upper arm 6, and then the presser foot lifting lever 24 is moved upwardly so as to permit the needle thread 10 to be received between the tension disks 22. Then, the needle thread 10 is extended downwardly along the arcuate surface 23*a* of the cover 23 so as to dispose the needle thread 10 in the left-hand guide groove 42 formed between the opening 11 and left side edge of cover 23. Then the needle thread 10 is pulled along the inclined surface 23*b* of the cover 23 so as to dispose the needle thread 10 in the right-hand guide groove 43 formed between the opening 11 and the right side edge of cover 23.

When the loop tightening member 20 is located at the lowermost position PB as illustrated in FIG. 3, the needle thread 10 is disposed within the recess 20*c* of the loop tightening member 20 when the needle thread 10 is inserted into the sewing head 5 through the opening 11, and then the needle thread 10 engages the first thread guide 44 as the same is pulled upwardly further. Then, the needle thread 10 is extended via the tension rod 61 projecting from the right side, as viewed in FIG. 5, of the cover 23, and then, still further, the needle thread is turned through a right angle by means of the second thread guide 45 so as to extend along the guide groove 39 formed in the front surface of the sewing head 5 as illustrated in FIG. 6 and thereby extend parallel to the needle bar 14. Continuing further, the needle thread 10 is inserted through the eye of the needle 13. During the threading operation, the movable member 21 is held at the stopping position PC by means of the resilient part 21*b* and the stopper 32, and hence the thread catch 21*a* of the movable member 21 is located above the thread supply path extending across the locus of the recess 20*c* of the loop tightening member 20 and toward the eye of the needle 13 without engaging the needle thread 10 whereby the movable member 21 is ready to subsequently engage the needle thread 10. Thus, the threading procedure is accomplished.

According to the present invention, during the threading operation the loop tightening member 20 may be located at any position. That is, when the loop tightening member 20 is located at a position between the uppermost position PA and a position corresponding to the stopping position PC, the movable member 21 is located at the stopping position PC, so that the needle thread 10 engages the thread catch 21*a* of the movable member 21, and thereby a predetermined length of the needle thread 10 is surely stored before starting the sewing operation. When the loop tightening member 20 is located at a position between the position corresponding to the stopping position PC and the lowermost position PB, the needle thread 10 engages the recess 20*c* of the loop tightening member 20, and thereby a sufficient length of the needle thread 10 is likewise secured.

Figure 7A:
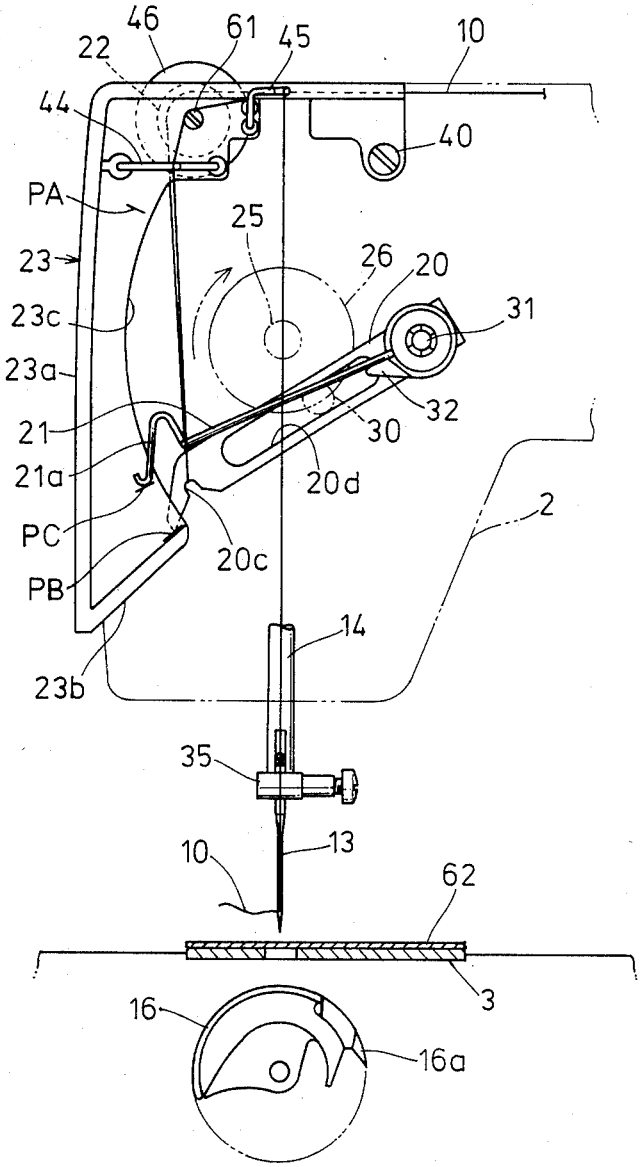
FIGS. 7A to 7H are views illustrating the positional relationship between the loop tightening member, the movable member and the loop-seizing beak of the shuttle in various phases of operation of the sewing machine.

FIG. 7A illustrates an exemplary positional relationship defined between the loop tightening member 20, the movable member 21 and the shuttle 16 at the completion of the threading operation. In this state, the presser foot lifting lever 24 is moved downwardly so as to lower the presser foot 15 so that a work fabric 62 can be pressed against the throat plate 3 by means of the presser foot 15, and the needle thread 10 can be resiliently retained between the tension disks 22. Then, a start button, not shown, is pressed so as to start the sewing operation. Subsequently, the shuttle 16 is turned into the counterclockwise direction, as viewed in FIG. 7A, toward the limit position. The timing pulley 26 is then rotated into the clockwise direction by means of the timing belt 28. Consequently, the loop tightening member 20 is pivoted in the clockwise direction from the lowermost position PB as a result of the cooperative action of the fixed shaft 30 fixed to the disk 26*a* of the timing pulley 26 and the slot 20*d* formed in the loop tightening member 20. At the same time, the needle bar 14 holding the needle 13 threaded with the needle thread 10 is caused to start moving downwardly by the crank action of the first crank rod 36 and the second crank rod 37.

Figure 7B:
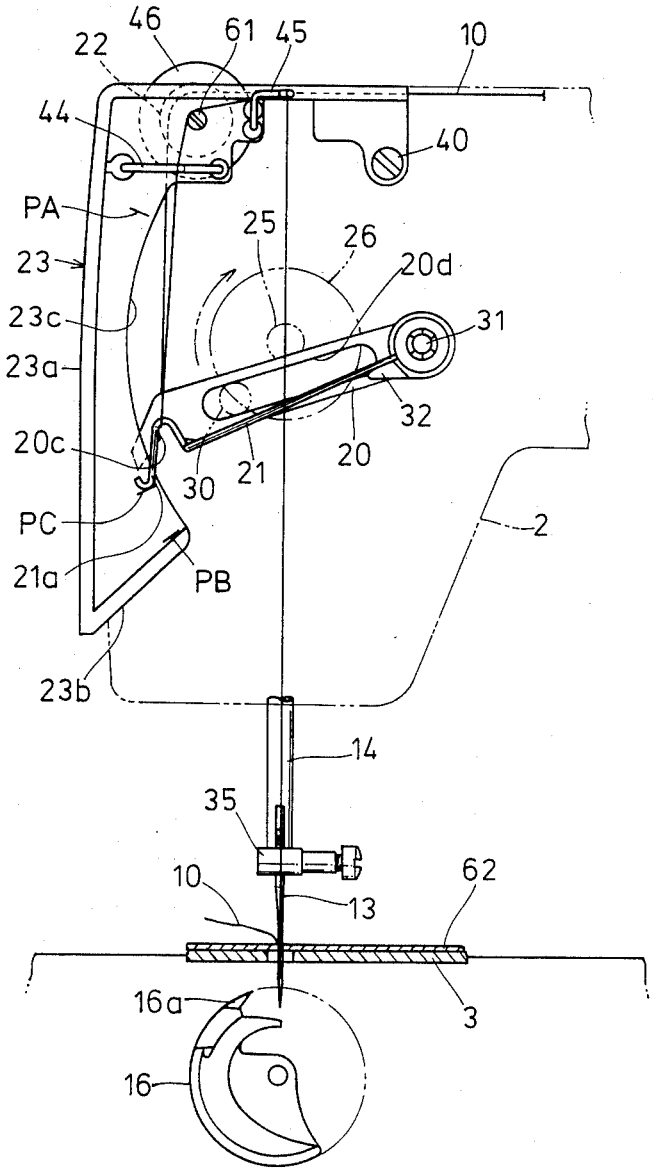

As illustrated in FIG. 7B, the needle bar 14 is lowered further to its lowermost position so as to thrust the needle 13 through the work fabric 62 placed on the throat plate 3 and to place the needle thread 10 on the locus of the loop-seizing beak 16*a* of the shuttle 16 which is rotating in the clockwise direction. Since the movable member 21 is held at the stopping position PC as a result of the resilience of the resilient part 21*b*, the needle thread 10 is transferred from the recess 20*c* of the loop tightening member 20 to the inverted U-shaped thread catch 21*a* of the movable member 21 upon the movement of the recess 20*c* past the thread catch 21*a* as the loop tightening member 20 is raised from the lowermost position PB.

Figure 7C:
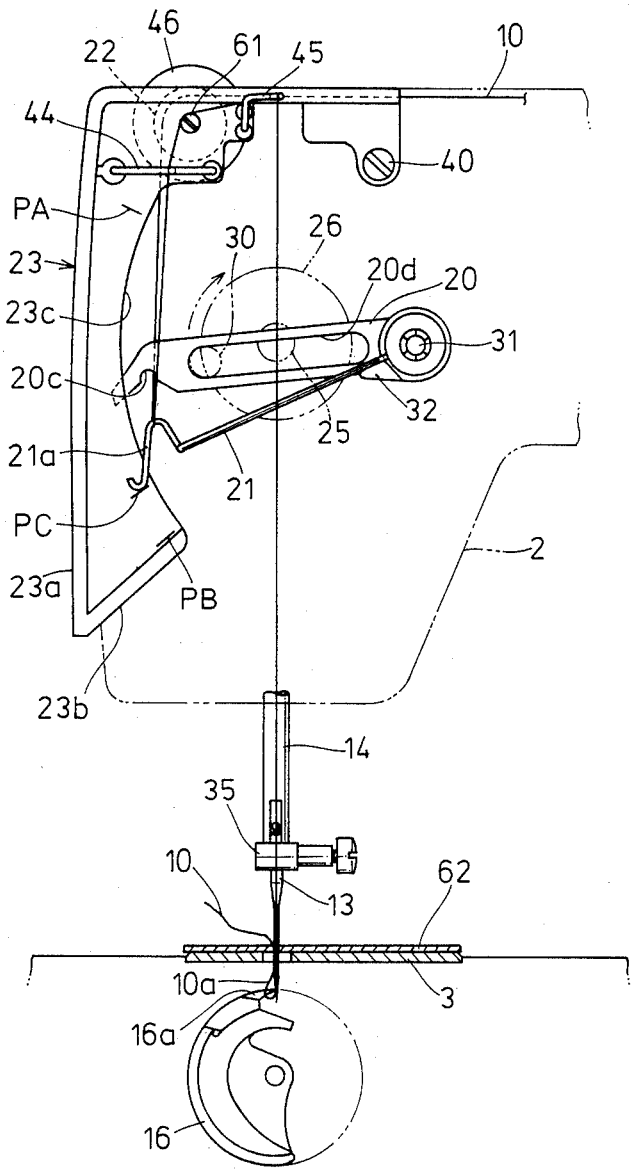

Then, as illustrated in FIG. 7C, the needle bar 14 starts moving upwardly from its lowermost position, so that a loop 10*a* is formed in the needle thread 10 extending below the throat plate 3 within the vicinity of the shuttle 16. As the shuttle 16 is rotated in the clockwise direction, the thread-seizing beak 16*a* seizes the loop 10*a*. At this moment, the movable member 21 is still held on the stopper 32 and remains at the stopping position PC, while the needle thread 10 is pulled downwardly along the thread supply path as the shuttle 16 turns with the loop-seized beak 16*a* seizing the loop 10*a*.

Figure 7D:
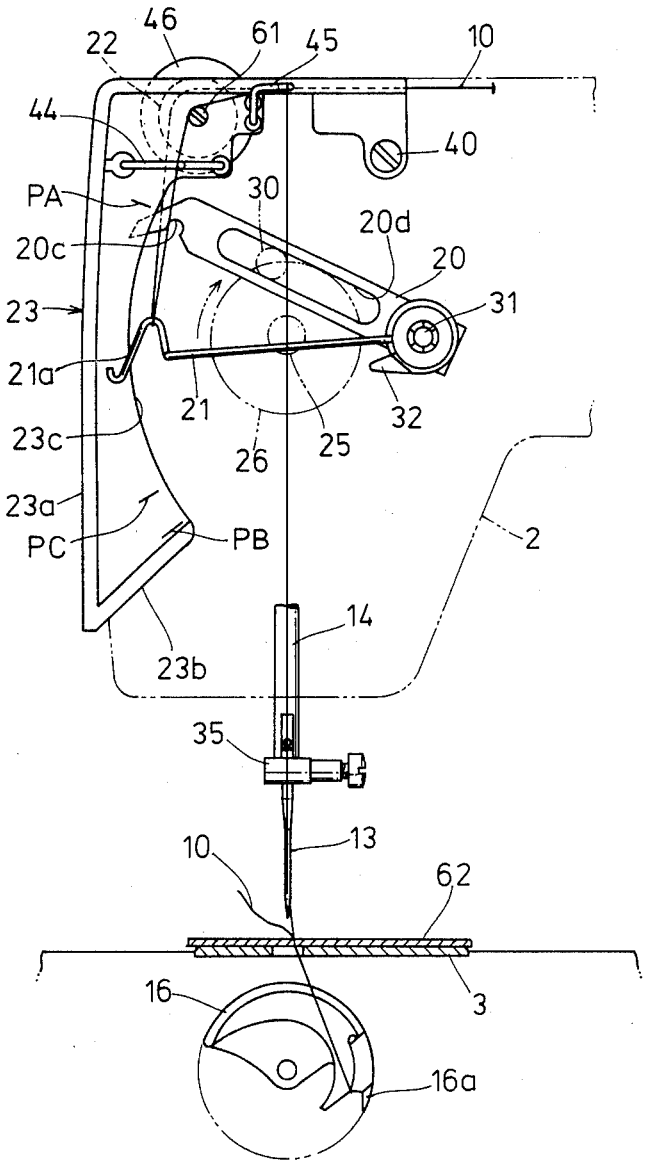
Figure 7E:
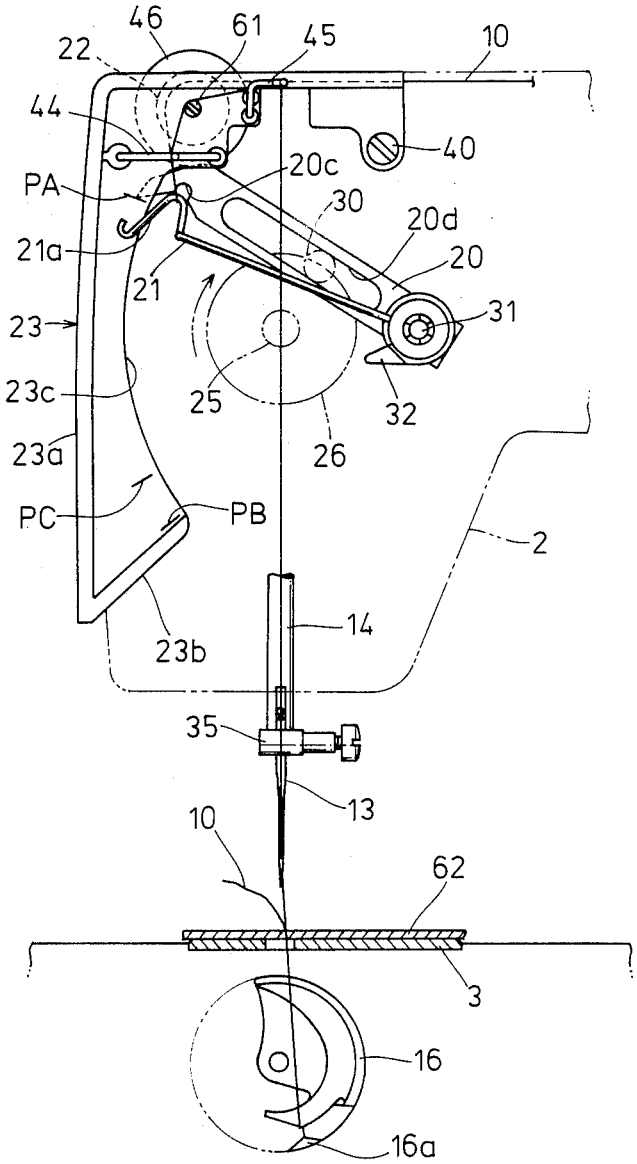

As seen from FIG. 7D, as the needle thread 10 is withdrawn from its spool supply, the movable member 21 engaging the needle thread 10 at the thread catch 21*a* thereof is lifted upwardly against the resilience of the resilient part 21*b* from the stopping position PC. As illustrated in FIG. 7E, upon the arrival of the loop tightening member 20 at the uppermost position PA, the movable member 21 arrives at the upper limit position, while the needle thread 10 having been seized by the loop-seizing beak 16*a* is properly withdrawn from the spool supply by the shuttle 16. At this moment, the loop 10*a* remains caught by the loop-seizing beak 16*a*.

Figure 7F:
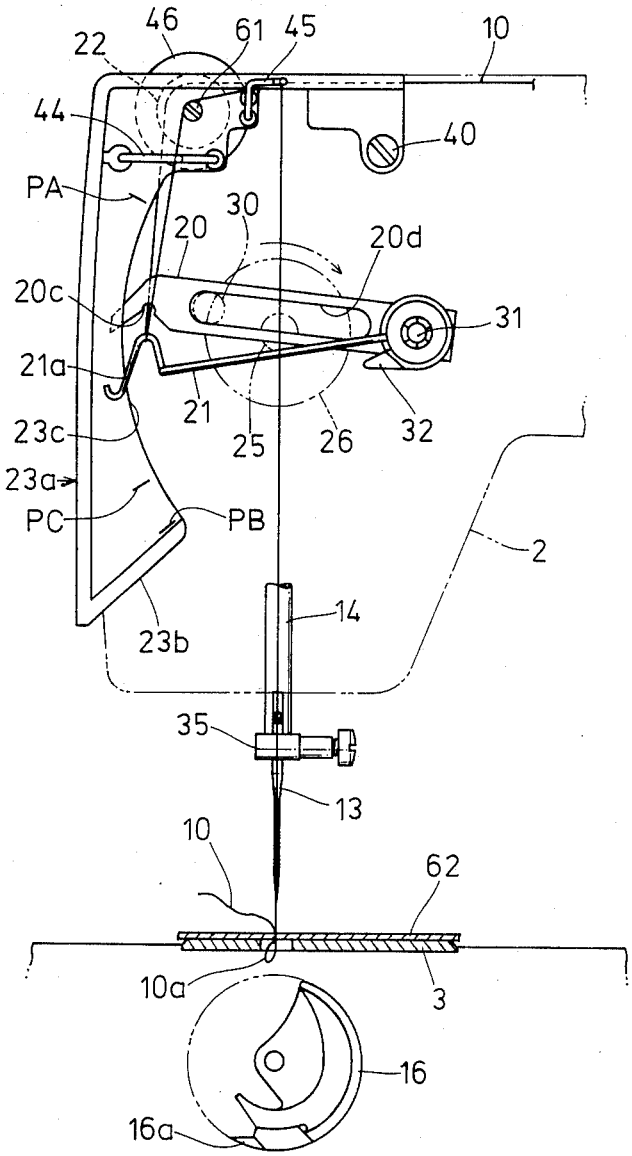

Then, as illustrated in FIG. 7F, the loop tightening member 20 starts moving in the counterclockwise direction from the uppermost position PA. The rotational direction of the shuttle 16 is reversed at a predetermined time, so that the loop 10*a* is released from the loop-seizing beak 16*a*. Then, the movable member 21 engaging the needle thread 10 is pivoted under the influence of the resilience of the resilient part 21*b* thereof toward the stopping position PC. Consequently, the needle thread 10 is tensioned through the eye of the needle 13 so as to tighten the stitch. Since the needle thread 10 is rapidly tensioned by the resilient force of the movable member 21 acting on the needle thread 10 in the thread tensioning direction, immediately after the loop 10*a* has been released from the loop-seizing beak 16*a*, the needle thread is separated very rapidly from the shuttle 16.

Figure 7G:
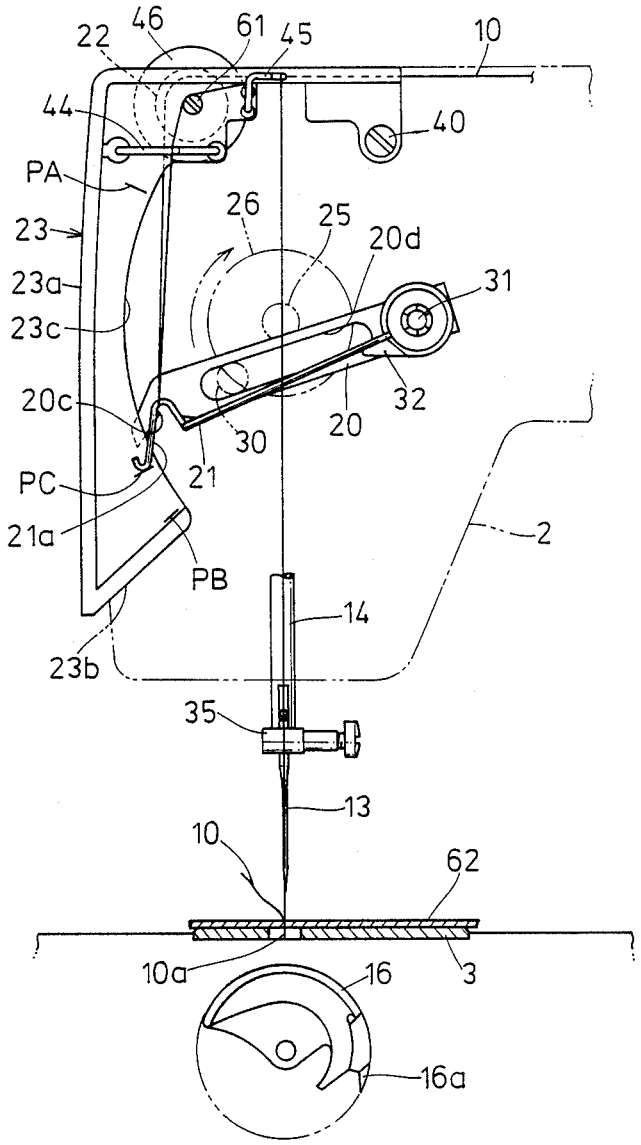
Figure 7H:
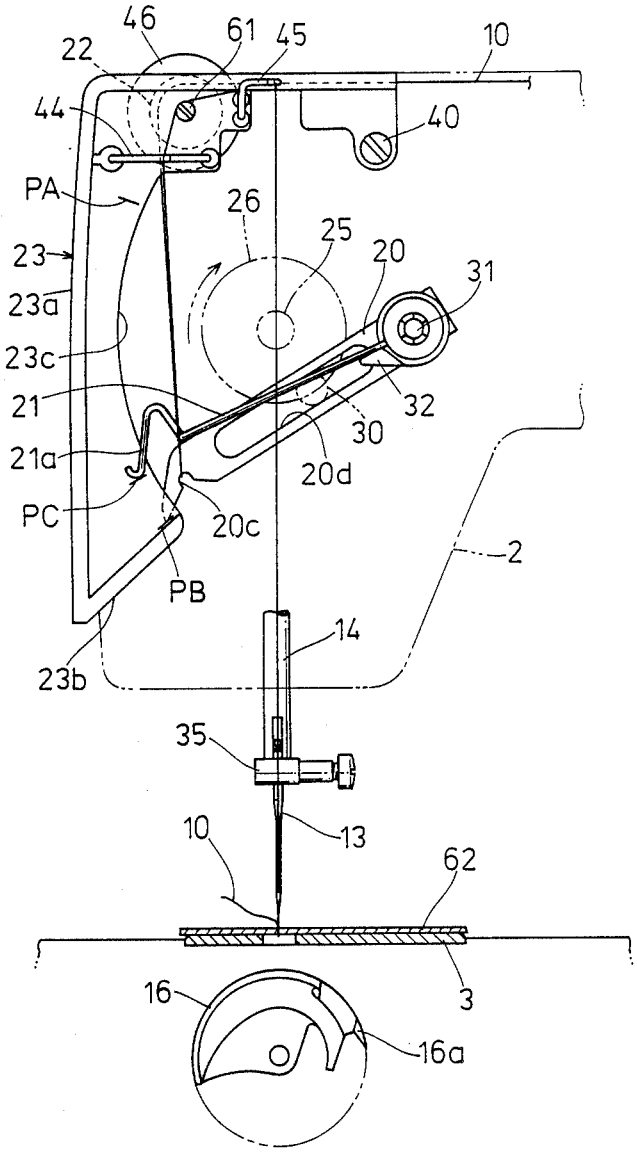

The loop tightening action of the movable member 21 lasts until the movable member 21 arrives at the position shown in FIG. 7G. Since the practically constant resilient force of the resilient part 21*b* acting as a torsion coil spring is applied to the loop 10*a* while the shuttle 16 rotates within the range from the position shown in FIG. 7F to the position shown in FIG. 7G, the loop 10*a* released from the shuttle 16 is never caught by any part of the shuttle 16, so that a satisfactory uniform loop tightening function is achieved. Finally, the movable member 21 is stopped by the stopper 32 provided near the fixed shaft 31 and is again retained at the stopping position PC as shown in FIG. 7G.

The loop tightening member 20 is moved further in the counterclockwise direction until it passes a position corresponding to the stopping position PC of the movable member 21. Then, the needle thread 10 which has been in engagement with the thread catch 21*a* of the movable member 21 is transferred from the thread catch 21*a* to the recess 20*c* of the loop tightening member 20 as illustrated in FIG. 7H. While being moved further toward the lowermost position PB, the loop tightening member 20 tightens the needle thread 10 further until the stitch is properly tightened. This sewing cycle is repeated to form stitches and to tighten the stitches.

Obviously, many modifications and variations of the present invention are possible in light of the above teachings. It is therefore to be understood that within the scope of the appended clams, the present invention may be practiced otherwise than as specifically described herein.

What is claimed is:

1. A thread take-up device for a sewing machine having an endwise reciprocating needle with an eye, a loop seizing member operative to seize a thread loop formed at the eye of said needle and to then expand said thread loop to a maximum extent in timed relation with respect to the reciprocation of said needle, and a thread path extending from a thread supply to said eye of said needle, said thread take-up device comprising:

a loop tightening member operative to tighten said thread loop in a time relation with respect to the reciprocation of said needle, said loop tightening member being adapted to reciprocate within a predetermined range between a thread slackening limit position at which said loop tightening member is disposed when said thread loop is expanded to said maximum extent and a loop tightening limit position at which said loop tightening member is disposed so as to tighten said thread loop;

a movable member disposed adjacent to said loop tightening member so as to move along a path substantially coincident with the locus of the reciprocation of said loop tightening member for tightening said thread loop, said movable member being capable of moving from a predetermined stopping position toward said thread slackening limit position, said predetermined stopping position being located close to said loop tightening limit position and within said predetermined range of movement of said loop tightening member; and elastic means for biasing said movable member toward said predetermined stopping position, whereby said movable member may take up said thread from said eye of said needle as a result of the elastic force of said elastic means when said loop tightening member is located between said predetermined stopping position and said thread slackening limit position.

2. A thread take-up device for a sewing machine according to claim 1, wherein said elastic means imparts a substantially constant elastic force to said movable member when said movable member is disposed between said predetermined stopping position and said thread slackening limit position.

3. A thread take-up device for a sewing machine according to claim 2, wherein said elastic means comprises a torsion coil spring wound around a fixed shaft disposed perpendicular to a plane in which said movable member moves.

4. A thread take-up device for a sewing machine according to claim 1, wherein said movable member is integrally formed with said elastic means.

5. A thread take-up device for a sewing machine according to claim 1, further including a stopper for holding said movable member at said predetermined stopping position.

6. A thread take-up device for a sewing machine according to claim 1, wherein said loop tightening member and said movable member are pivotable about a common fixed shaft.

7. A thread take-up device for a sewing machine according to claim 1, wherein said loop tightening member is pivotable about a fixed shaft and has at its free end a recess for catching said thread.

8. A thread take-up device for a sewing machine as set forth in claim 5, wherein:

said stopper, said loop tightening member, and said movable member are also mounted upon a common fixed shaft.

9. A thread take-up device for a sewing machine as set forth in claim 1, wherein:

said movable member is provided with a substantially inverted U-shaped thread-catch portion at the free end thereof.

10. A thread take-up device for a sewing machine having an endwise reciprocating needle with an eye, a loop seizing member operative to seize a thread loop formed at said eye of said needle and to then expand said thread loop to a maximum extent in timed relation with respect to the reciprocation of said needle, and a thread path extending from a thread supply to said eye of said needle, said thread take-up device comprising:

a loop tightening member pivotably supported upon a fixed shaft for tightening said thread loop in timed relation with respect to the reciprocation of said needle, said loop tightening member being adapted to pivot within a predetermined range of movement between a thread slackening limit position at which said loop tightening member is disposed when said thread loop is expanded to said maximum extent and a loop tightening limit position at which said loop tightening member is disposed so as to tighten said thread loop;

a movable member pivotably supported upon said fixed shaft and having a pivot path which is substantially coincident with the locus of said pivotable movement of said loop tightening member, said movable member being capable of moving from a predetermined stopping position toward said thread slackening limit position, said predetermined stopping position being located close to said loop tightening limit position and within said predetermined range of movement of said loop tightening member; and elastic means for biasing said movable member toward said predetermined stopping position, whereby said movable member may take up said thread from said eye of said needle as a result of the elastic force of said elastic means when said loop tightening member is located between said predetermined stopping position and said thread slackening limit position.

11. A thread take-up device for a sewing machine as set forth in claim 10, wherein:

said elastic means imparts a substantially constant elastic force to said movable member when said movable member is disposed between said predetermined stopping position and said thread slackening limit position.

12. A thread take-up device for a sewing machine as set forth in claim 10, wherein:

said elastic means comprises a torsion coil spring wound around a fixed shaft disposed perpendicular to a plane in which said movable member moves.

13. A thread take-up device for a sewing machine as set forth in claim 10, wherein:

said elastic means and said movable member are integrally formed together.

14. A thread take-up device for a sewing machine as set forth in claim 10, further comprising:

a stopper for retaining said movable member at said predetermined stopping position.

15. A thread take-up device for a sewing machine as set forth in claim 14, wherein:

said loop tightening member and said movable member, along with said stopper, are all mounted upon said fixed shaft.

16. A thread take-up device for a sewing machine as set forth in claim 10, wherein:

said loop tightening member has a thread-catching recess formed at the free end thereof.

17. A thread take-up device for a sewing machine as set forth in claim 10, wherein:

said movable member has a substantially inverted U-shaped thread-catch portion formed at the free end thereof.

* * * * *